US009172125B1

(12) United States Patent
Makino

(10) Patent No.: US 9,172,125 B1
(45) Date of Patent: Oct. 27, 2015

(54) NON-RECIPROCAL CIRCUIT ELEMENT

(71) Applicant: Murata Manufacturing Co., Ltd., Nagaokakyo-shi, Kyoto-fu (JP)

(72) Inventor: Toshihiro Makino, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 14/794,934

(22) Filed: Jul. 9, 2015

Related U.S. Application Data

(60) Division of application No. 14/540,342, filed on Nov. 13, 2014, now Pat. No. 9,112,256, which is a continuation of application No. PCT/JP2013/065440, filed on Jun. 4, 2013.

(30) Foreign Application Priority Data

Jul. 2, 2012 (JP) ..... 2012-148282

(51) Int. Cl.
*H01P 1/383* (2006.01)
*H01F 7/02* (2006.01)
*H01P 1/387* (2006.01)

(52) U.S. Cl.
CPC *H01P 1/383* (2013.01); *H01F 7/02* (2013.01); *H01P 1/387* (2013.01)

(58) Field of Classification Search
CPC ..... H01P 1/32; H01P 1/38; H01P 1/383
USPC ..... 333/1.1, 24.2
See application file for complete search history.

(56) References Cited

U.S. PATENT DOCUMENTS 3,818,381 A * 6/1974 Konishi ..... H01P 1/387 333/1.1
3,836,874 A * 9/1974 Maeda ..... H01P 1/387 333/1.1

OTHER PUBLICATIONS

Makino, "Non-Reciprocal Circuit Element", U.S. Appl. No. 14/540,342, filed Nov. 13, 2014.

* cited by examiner

*Primary Examiner* — Stephen E Jones
(74) *Attorney, Agent, or Firm* — Keating & Bennett, LLP

(57) ABSTRACT

In a non-reciprocal circuit element, first to third center conductors intersect one another in an insulated state around a microwave magnetic body, and first ends of the first to third center conductors define first to third ports. A first capacitance element is connected to the first center conductor in parallel and a second capacitance element is connected to the second center conductor in parallel, and the other ends of the first to third center conductors are connected to one another and are grounded via a first inductance element and a third capacitance element that are connected in series. A second inductance element is connected to one end of the center conductor in parallel, and the other end of the second inductance element is grounded. A fourth capacitance element is connected to a connection point between the one end of the center conductor and the second inductance element, and the other end of the fourth capacitance element is connected to a third terminal.

4 Claims, 8 Drawing Sheets

NON-RECIPROCAL CIRCUIT ELEMENT

BACKGROUND OF THE INVENTION

1. Field of the Invention

The present invention relates to non-reciprocal circuit elements, and particularly relates to non-reciprocal circuit elements such as isolators, circulators, and the like preferably for use in microwave bands.

2. Description of the Related Art

Non-reciprocal circuit elements such as isolators, circulators, and the like have conventionally had characteristics in which signals are transmitted only in a predetermined specific direction, and are not transmitted in the reverse direction. Using such characteristics, an isolator, for example, is used as a sending circuit portion in a mobile communication device such as a cellular phone or the like.

The elements disclosed in Japanese Unexamined Utility Model Registration Application Publication No. 6-013203 and Japanese Examined Utility Model Registration Application Publication No. 2-018561 are known as three-terminal type circulators, which is one type of non-reciprocal circuit element. As shown in FIG. 2, which corresponds to Japanese Unexamined Utility Model Registration Application Publication No. 6-013203, and in FIG. 5, which corresponds to Japanese Examined Utility Model Registration Application Publication No. 2-018561, the isolation characteristics of the element are monophasic. However, there are cases, depending on the circuit in which the circulator, the isolator, or the like is used, in which flat isolation characteristics are desired, and thus there is a problem in that this type of circulators, isolators, or the like cannot be used in such cases.

For example, in a wireless communication apparatus 100 shown in FIG. 11, a circulator S is provided between a noise canceler NC and an antenna ANT. The circulator S cancels out noise in a reception band by setting the phases of a signal inputted from the antenna ANT and a signal outputted from the noise canceler NC to be inverted by 180° relative to each other. The amplitude characteristics of the noise canceler NC are almost flat, and thus a similar degree of flatness is required in the isolation characteristics of the circulator S as well.

Meanwhile, in an RF circuit 150 of a cellular phone shown in FIG. 12, an isolator I is provided between a power amp PA and a duplexer DPX. A signal outputted from the power amp PA is partially inputted to a gain control circuit AGC via a capacitor C, and an output voltage is monitored. In the case where there is a high amount of reflection from the antenna ANT, the isolator I has isolation characteristics that are low and not flat, and the frequency characteristics are high, the magnitude of power outputted from the power amp PA cannot be accurately detected. Furthermore, the gain control circuit AGC will not operate accurately, and the output of the power amp PA cannot be controlled accurately as a result. Accordingly, flat isolation characteristics are desired in this case as well.

SUMMARY OF THE INVENTION

Accordingly, preferred embodiments of the present invention provide a non-reciprocal circuit element that makes isolation characteristics almost flat.

According to a first aspect of various preferred embodiments of the present invention, in a non-reciprocal circuit element, a first center conductor, a second center conductor, and a third center conductor are disposed, in an insulated state and intersecting with one another, around a microwave magnetic body to which a direct current magnetic field is applied by a permanent magnet; one end of the first center conductor defines a first port, one end of the second center conductor defines a second port, and one end of the third center conductor defines a third port; the first port is connected to a first terminal, the second port is connected to a second terminal, and the third port is connected to a third terminal; a first capacitance element is connected to the first center conductor in parallel, and a second capacitance element is connected to the second center conductor in parallel; other ends of the first center conductor, the second center conductor, and the third center conductor are connected to one another, and are grounded via a first inductance element and a third capacitance element that are connected in series; a second inductance element is connected to one end of the third center conductor in parallel, and another end of the second inductance element is grounded; and a fourth capacitance element is connected to a connection point between the one end of the third center electrode and the second inductance element, and another end of the fourth capacitance element is connected to the third terminal.

According to a second aspect of various preferred embodiments of the present invention, in a non-reciprocal circuit element, a first center conductor, a second center conductor, and a third center conductor are disposed, in an insulated state and intersecting with one another, around a microwave magnetic body to which a direct current magnetic field is applied by a permanent magnet; one end of the first center conductor defines a first port, one end of the second center conductor defines a second port, and one end of the third center conductor defines a third port; the first port is connected to a first terminal, the second port is connected to a second terminal, and the third port is connected to a third terminal; a first capacitance element is connected to the first center conductor in parallel, and a second capacitance element is connected to the second center conductor in parallel; other ends of the first center conductor, the second center conductor, and the third center conductor are connected to one another, and are grounded via a first inductance element and a third capacitance element that are connected in series; a second inductance element is connected to the third center conductor in parallel; and a fourth capacitance element is connected to a connection point between the one end of the third center electrode and the second inductance element, and another end of the fourth capacitance element is connected to the third terminal.

According to a third aspect of various preferred embodiments of the present invention, in a non-reciprocal circuit element, a first center conductor, a second center conductor, and a third center conductor are disposed, in an insulated state and intersecting with one another, around a microwave magnetic body to which a direct current magnetic field is applied by a permanent magnet; one end of the first center conductor defines a first port, one end of the second center conductor defines a second port, and one end of the third center conductor defines a third port; the first port is connected to a first terminal, and the second port is connected to a second terminal; a first capacitance element is connected to the first center conductor in parallel, and a second capacitance element is connected to the second center conductor in parallel; other ends of the first center conductor, the second center conductor, and the third center conductor are connected to one another, and are grounded via a first inductance element and a third capacitance element that are connected in series; a second inductance element is connected to the third center conductor in parallel; and a fourth capacitance element is connected in series to a connection point between the one end of the third center electrode and the second inductance element, a resistance element is further connected in series, and another end of the resistance element is grounded.

According to a fourth aspect of various preferred embodiments of the present invention, in a non-reciprocal circuit element, a first center conductor, a second center conductor, and a third center conductor are disposed, in an insulated state and intersecting with one another, around a microwave magnetic body to which a direct current magnetic field is applied by a permanent magnet; one end of the first center conductor defines a first port, one end of the second center conductor defines a second port, and one end of the third center conductor defines a third port; the first port is connected to a first terminal, the second port is connected to a second terminal, and the third port is connected to a third terminal; a first capacitance element is connected to the first center conductor in parallel, and a second capacitance element is connected to the second center conductor in parallel; other ends of the first center conductor, the second center conductor, and the third center conductor are connected to one another, and are grounded via a first inductance element and a third capacitance element that are connected in series; a fifth capacitance element is connected to the third center conductor in parallel; a fourth capacitance element is connected in series to a connection point between the one end of the third center electrode and the fifth capacitance element, a third inductance element is further connected in series, and another end of the third inductance element is connected to the third terminal; and a sixth capacitance element is connected to the connection point between the one end of the third center conductor and the fifth capacitance element, and another end of the sixth capacitance element is grounded.

In the non-reciprocal circuit element, the first center conductor, the second center conductor, and the third center conductor are intersected, in an insulated state, around a ferrite to which a direct current magnetic field is applied by a permanent magnet. The non-reciprocal circuit elements according to the first, second, and fourth aspects of various preferred embodiments of the present invention define and function as circulators, such that, for example, a high-frequency signal inputted from the second port is outputted from the first port, a high-frequency signal inputted from the first port is outputted from the third port, and a high-frequency signal inputted from the third port is outputted from the second port. The non-reciprocal circuit element according to the third aspect of various preferred embodiments of the present invention defines and functions as an isolator, such that, for example, a high-frequency signal inputted from the first port is outputted from the second port. On the other hand, a high-frequency signal inputted from the second port is not outputted to the first port due to the third port being terminated by the resistance element.

Note that the input/output relationships of the high-frequency signals are reversed by inverting the direct current magnetic field applied by the permanent magnet.

In the non-reciprocal circuit element according to the first, second, and third aspects of various preferred embodiments of the present invention, the second inductance element is connected to the third center conductor in parallel, and thus the isolation characteristics are almost flat across a wide bandwidth. Meanwhile, in the non-reciprocal circuit element according to the fourth aspect of various preferred embodiments of the present invention, the fifth capacitance element is connected to the third center conductor in parallel, the sixth capacitance element is connected to the connection point between the one end of the third center conductor and the fifth capacitance element, and the other end of the sixth capacitance element is grounded; as a result, the isolation characteristics are almost flat across a wide bandwidth.

According to various preferred embodiments of the present invention, a non-reciprocal circuit element that makes isolation characteristics almost flat is provided.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
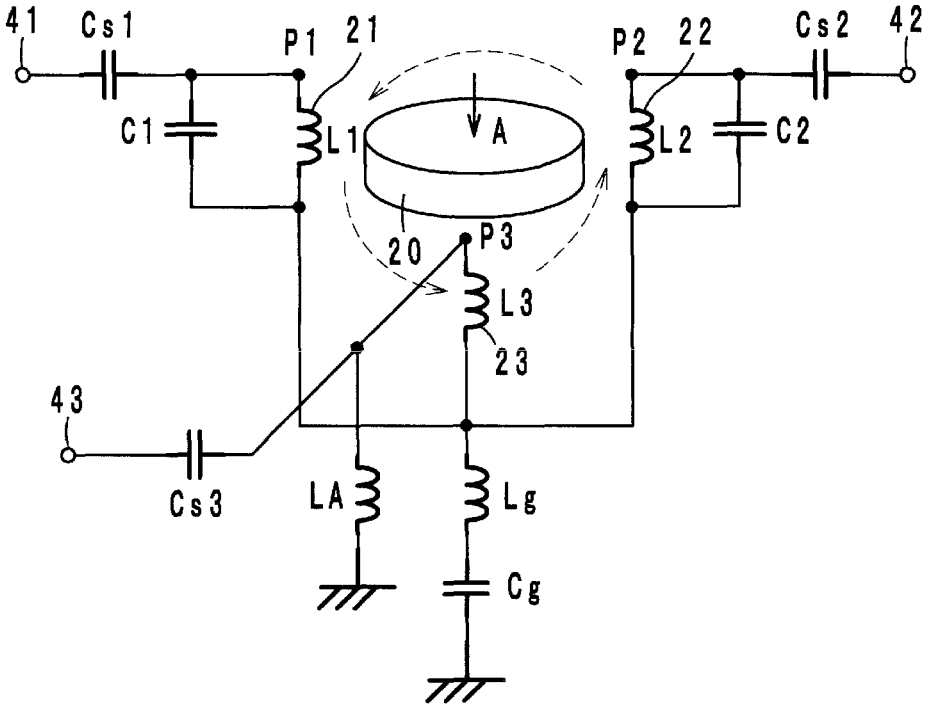
FIG. 1 is an equivalent circuit diagram illustrating a non-reciprocal circuit element (a three-port circulator) according to a first preferred embodiment of the present invention.

Preferred embodiments of a non-reciprocal circuit element according to the present invention will be described below with reference to the accompanying drawings. Note that members that are the same in the drawings will be given the same reference numerals, and redundant descriptions thereof will be omitted.

First Preferred Embodiment

A non-reciprocal circuit element according to the first preferred embodiment is a concentrated-constant three-port circulator having the equivalent circuit configuration shown in FIG. 1. A first center conductor 21 (L1), a second center conductor 22 (L2), and a third center conductor 23 (L3) are disposed, in an insulated state and intersecting with one another, around a microwave magnetic body (a ferrite 20) to which a direct current magnetic field is applied in the direction of an arrow A by a permanent magnet; one end of the first center conductor 21 defines a first port P1, one end of the second center conductor defines a second port P2, and one end of the third center conductor 23 defines a third port P3.

Furthermore, the other ends of the center conductors 21, 22, 23 are connected to one another and are grounded via an inductance element Lg and a capacitance element Cg that are connected in series. Capacitance elements C1 and C2 are connected in parallel to the first and second center conductors 21 and 22, respectively. An inductance element LA is connected in parallel to one end of the third center conductor 23, and the other end of the inductance element LA is grounded. A capacitance element Cs3 configured to perform impedance matching is connected to the point of connection between one end of the third center electrode 23 and the inductance element LA, and the other end of the capacitance element Cs3 is connected to a third terminal 43.

Furthermore, a capacitance element Cs1 configured to perform impedance matching is connected between the first port P1 and a first terminal 41, and a capacitance element Cs2 configured to perform impedance matching is connected between the second port P2 and a second terminal 42.

Figure 2:
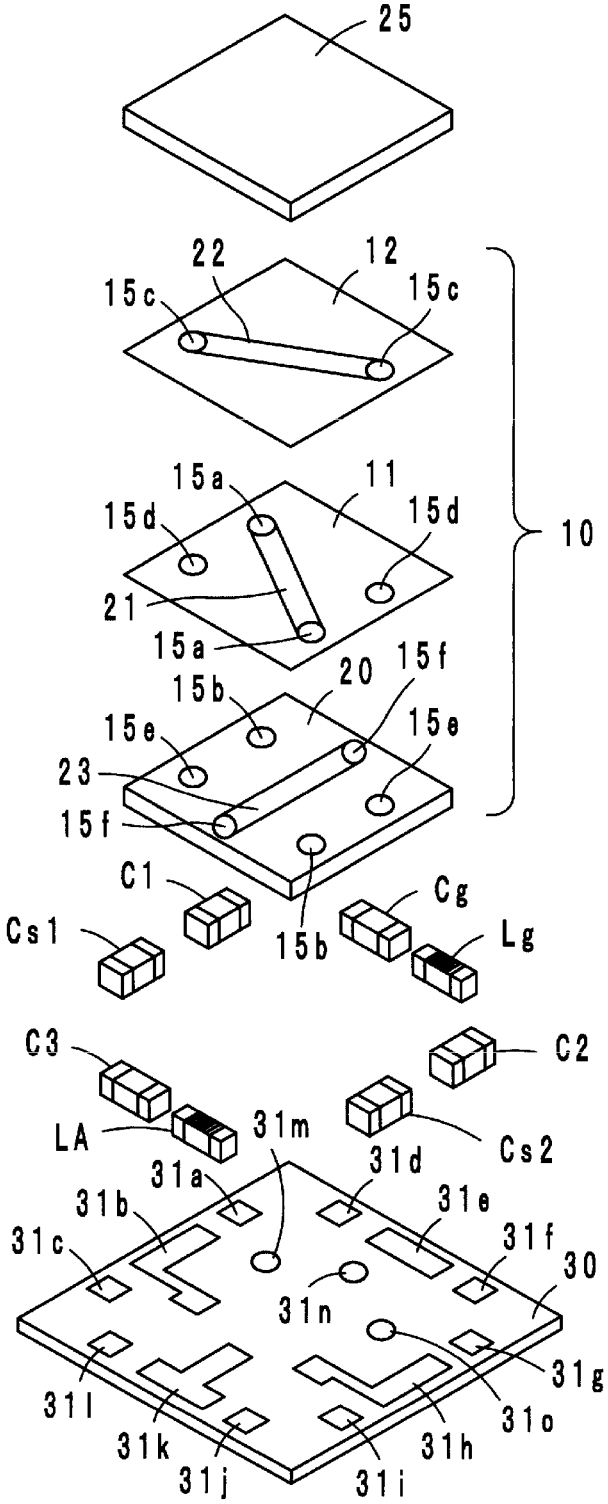
FIG. 2 is an exploded perspective view illustrating the non-reciprocal circuit element according to the first preferred embodiment of the present invention.

The three-port circulator configured of the equivalent circuit described thus far is configured specifically of a circuit board 30, a center conductor assembly 10, and a permanent magnet 25, as shown in FIG. 2.

In the center conductor assembly 10, insulation layers 11 and 12 are layered upon an upper surface of the rectangular microwave ferrite 20, the first center conductor 21 is disposed on an upper surface of the insulation layer 11, and both end portions thereof extend toward a bottom surface of the ferrite 20 through a via hole conductor 15*a* and a via hole conductor 15*b* provided in the ferrite 20. The second center conductor 22 is disposed on an upper surface of the insulation layer 12, and both end portions thereof extends toward a bottom surface of the ferrite 20 through a via hole conductor 15*c*, a via hole conductor 15*d* provided in the insulation layer 11, and a via hole conductor 15*e* provided in the ferrite 20. The third center conductor 23 is disposed on the top surface of the ferrite 20, and extends toward the bottom surface of the ferrite 20 through a via hole conductor 15*f*.

The center conductors 21, 22, 23 can be thin film conductors, thick film conductors, or conductive foils on the ferrite 20, the insulation layers 11 and 12, and so on. Meanwhile, the various capacitance elements, inductance elements, and so on are preferably chip components. Note that the center conductors 21, 22, 23 may be wrapped in coil form with an increased number of insulation layers being provided.

The electrodes 31*a*-31*o* are disposed on a top surface of the circuit board 30 in order to mount the end portions of the respective center conductors 21, 22, 23, the chip-type various capacitance elements, the inductance elements, and so on, and the three-port circulator corresponding to the equivalent circuit shown in FIG. 1 is formed preferably by stacking and mounting the center conductor assembly 10 and the permanent magnet 25 upon the circuit board 30. Although not shown, the first terminal 41, the second terminal 42, and the third terminal 43 are disposed on a bottom surface of the circuit board 30.

In the three-port circulator according to the first preferred embodiment, a high-frequency signal inputted from the second terminal 42 (the second port P2) is outputted from the first terminal 41 (the first port P1), a high-frequency signal inputted from the first terminal 41 (the first port P1) is outputted from the third terminal 43 (the third port P3), and a high-frequency signal inputted from the third terminal 43 (the third port P3) is outputted from the second terminal 42 (the second port P2). However, the transmission paths of the high-frequency signals are switched when the direction of the magnetic field applied to the ferrite 20 is reversed.

Figure 3:
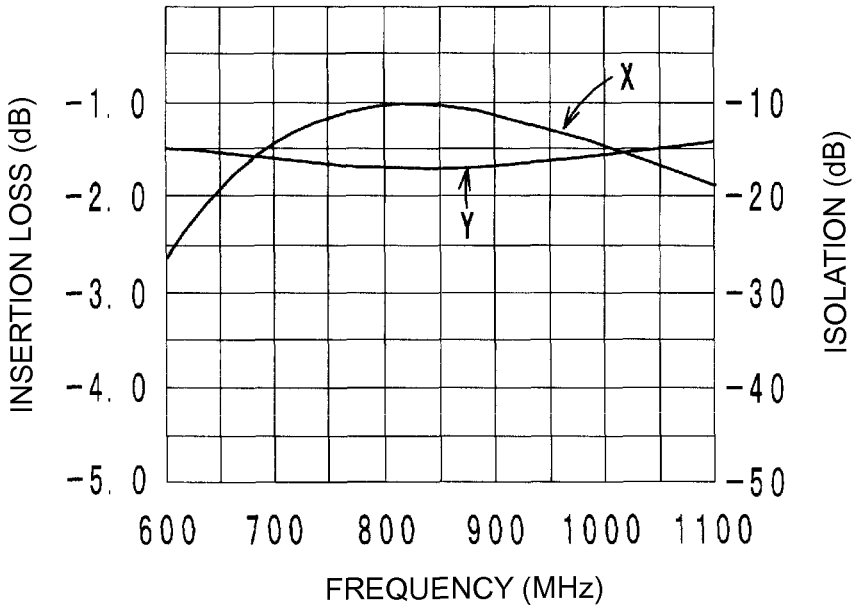
FIG. 3 is a graph illustrating insertion loss characteristics and isolation characteristics of the non-reciprocal circuit element according to the first preferred embodiment of the present invention.
Figure 4:
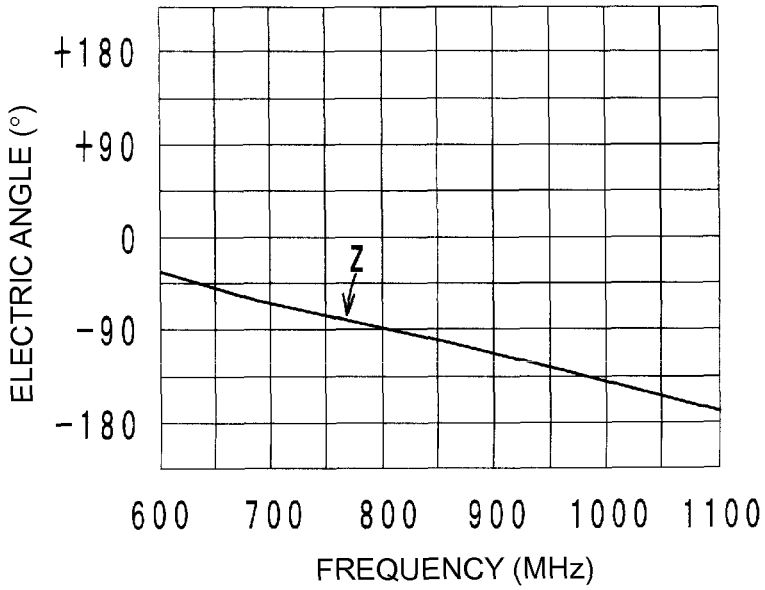
FIG. 4 is a graph illustrating electrical degree characteristics of the non-reciprocal circuit element according to the first preferred embodiment of the present invention.
Figure 11:
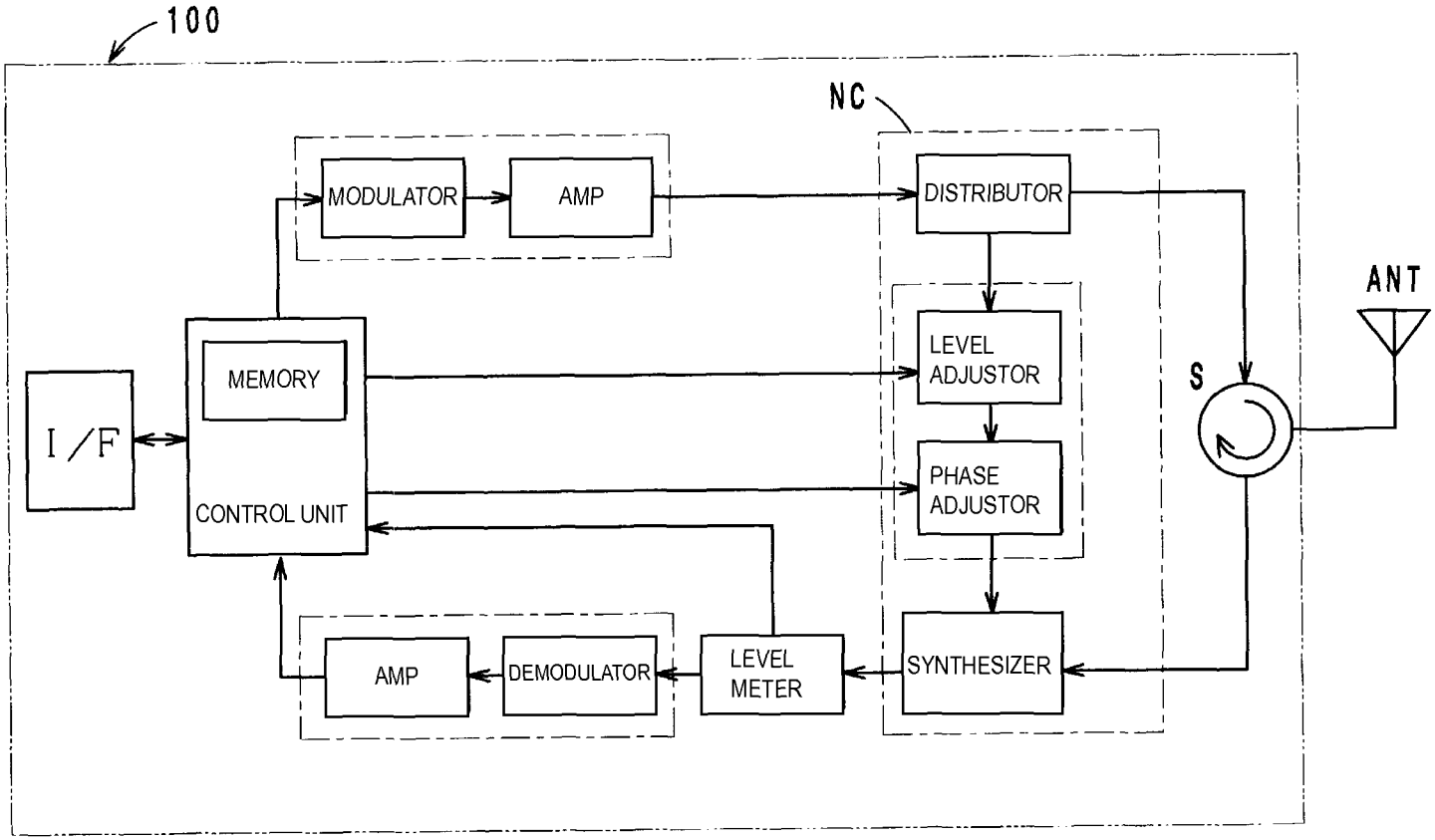
FIG. 11 PRIOR ART
FIG. 11 is a block diagram illustrating a wireless communication apparatus provided with a non-reciprocal circuit element.
Figure 12:
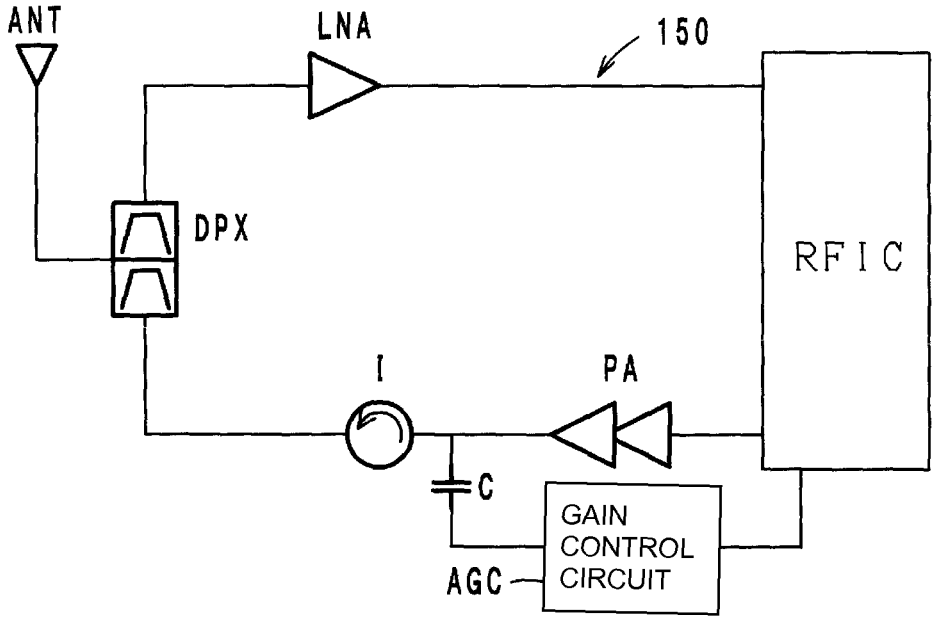
FIG. 12 PRIOR ART
FIG. 12 is a block diagram illustrating an RF circuit provided with a non-reciprocal circuit element.

In the three-port circulator according to the first preferred embodiment, insertion loss characteristics from the second terminal 42 to the first terminal 41 are indicated in FIG. 3 by a curve X, whereas isolation characteristics from the first terminal 41 to the second terminal 42 are indicated in FIG. 3 by a curve Y. The isolation characteristics are almost flat in an operational bandwidth of 698-960 MHz, with a deviation in the bandwidth of approximately ±0.6 dB, for example. Meanwhile, the isolation phase characteristics from the first terminal 41 to the second terminal 42 are almost a straight line, as indicated by a curve Z in FIG. 4. These phase characteristics are almost the same as the phase characteristics of the noise canceler NC shown in FIG. 11.

Characteristic configurations of the present first preferred embodiment are that the respective other ends of a parallel resonance circuit configured of (L1 and C1) and (L2 and C2) and L3 are all connected to a single point, and that connection point is grounded via a (Lg and Cg) serial resonance circuit; that LA is connected to L3 in parallel and the other end of LA is grounded; and furthermore, that Cs3 is connected to the connection point between L3 and LA, and the other end of Cs3 is connected to the third terminal 43. As a result of such characteristic configurations, the isolation characteristics from the first terminal 41 to the second terminal 42 are almost flat.

Second Preferred Embodiment

Figure 5:
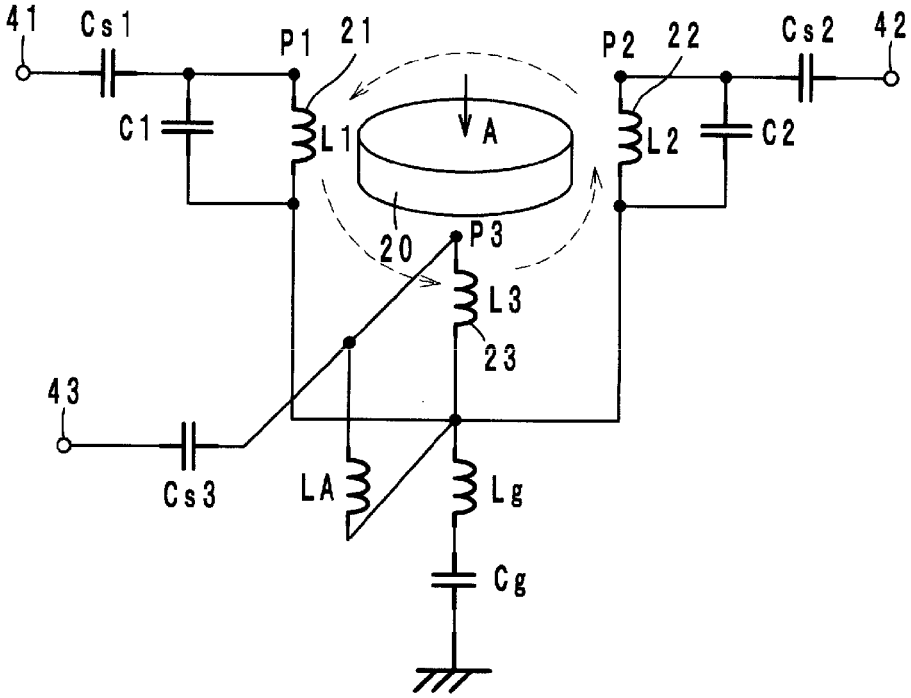
FIG. 5 is an equivalent circuit diagram illustrating a non-reciprocal circuit element (a three-port circulator) according to a second preferred embodiment of the present invention.

A non-reciprocal circuit element according to a second preferred embodiment is a concentrated-constant three-port circulator having the equivalent circuit configuration shown in FIG. 5. The same basic circuit configuration as in the first preferred embodiment is used here, with a difference being that the other end of the inductance element LA is connected to the other end of the third center conductor 23 (L3). The specific configurations of the center conductors 21, 22, 23 are basically the same as in the perspective view shown in FIG. 2.

Figure 6:
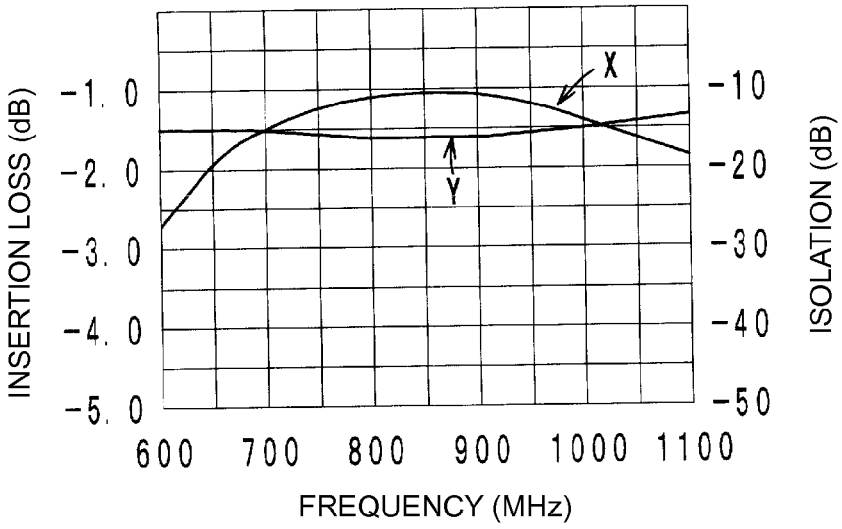
FIG. 6 is a graph illustrating insertion loss characteristics and isolation characteristics of the non-reciprocal circuit element according to the second preferred embodiment of the present invention.
Figure 7:
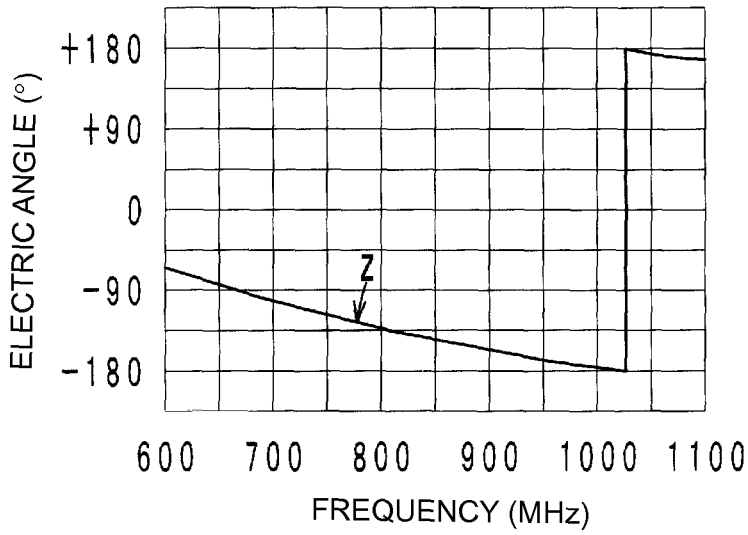
FIG. 7 is a graph illustrating electrical degree characteristics of the non-reciprocal circuit element according to the second preferred embodiment of the present invention.

A state of operation in the present second preferred embodiment preferably is basically the same as in the first preferred embodiment, and the same actions and effects are achieved. Insertion loss characteristics from the second terminal 42 to the first terminal 41 are indicated in FIG. 6 by a curve X, whereas isolation characteristics from the first terminal 41 to the second terminal 42 are indicated in FIG. 6 by a curve Y. The isolation characteristics are almost flat in an operational bandwidth of 698-960 MHz. Meanwhile, the isolation phase characteristics from the first terminal 41 to the second terminal 42 are almost a straight line, as indicated by a curve Z in FIG. 7.

Characteristic configurations of the present second preferred embodiment are that the respective other ends of a parallel resonance circuit configured of (L1 and C1) and (L2 and C2), and a parallel circuit (L3 and LA), are all connected to a single point, and that connection point is grounded via a (Lg and Cg) serial resonance circuit; and that Cs3 is connected to the connection point between L3 and LA, and the other end of Cs3 is connected to the third terminal 43. As a result of such characteristic configurations, the isolation characteristics from the first terminal 41 to the second terminal 42 are almost flat.

Third Preferred Embodiment

Figure 8:
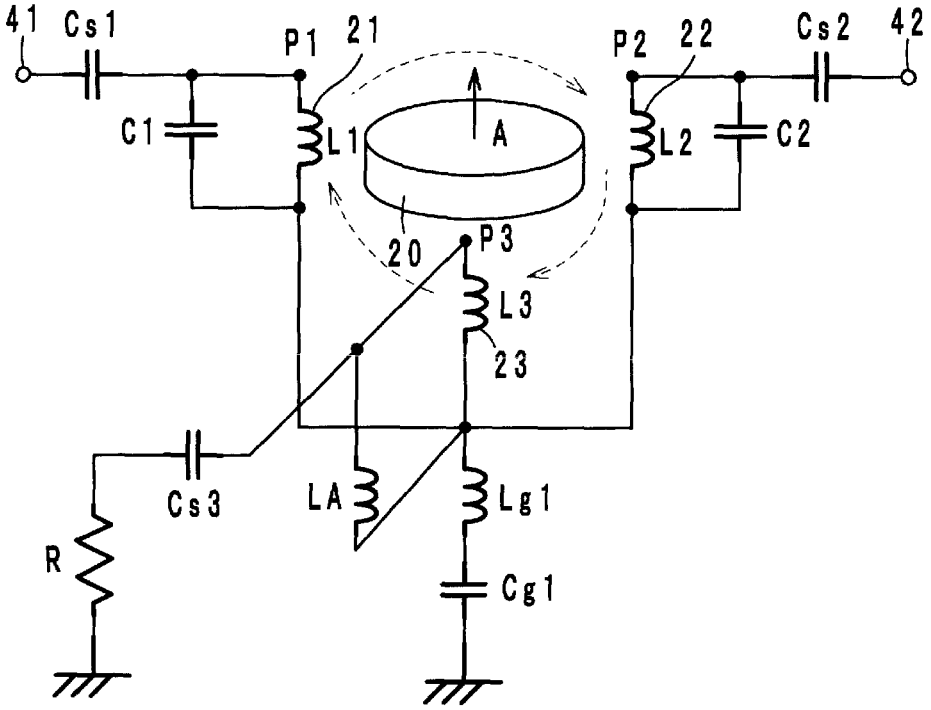
FIG. 8 is an equivalent circuit diagram illustrating a non-reciprocal circuit element (a two-port isolator) according to a third preferred embodiment of the present invention.

A non-reciprocal circuit element according to a third preferred embodiment is a concentrated-constant isolator having the equivalent circuit configuration shown in FIG. 8. The same basic circuit configuration as in the second preferred embodiment preferably is used here, with differences being that a resistance element R is connected in series to the capacitance element Cs3 and the other end of the resistance element R is grounded. In other words, the third port P3 is terminated by the resistance element R.

In the non-reciprocal circuit element according to the third preferred embodiment, a high-frequency signal inputted from the first terminal 41 (the first port P1) is outputted from the second terminal 42 (the second port P2). On the other hand, a high-frequency signal inputted from the second terminal 42 (the second port P2) is not outputted to the first terminal 41 (the first port P1) due to the third port P3 being terminated by the resistance element R.

In the present third preferred embodiment, insertion loss characteristics from the first terminal 41 to the second terminal 42 and isolation characteristics from the second terminal 42 to the first terminal 41 are almost the same as those described in the second preferred embodiment and illustrated in FIG. 6, and the isolation characteristics are almost flat in the operational bandwidth of 698-960 MHz. Furthermore, the isolation phase characteristics from the second terminal 42 to the first terminal 41 are almost the same as those described in the second preferred embodiment and illustrated in FIG. 7.

Characteristic configurations of the present third preferred embodiment are that the respective other ends of a parallel resonance circuit configured of (L1 and C1) and (L2 and C2), and a parallel circuit (L3 and LA), are all connected to a single point, and that connection point is grounded via a (Lg and Cg) serial resonance circuit; and that Cs3 is connected to the connection point between L3 and LA, and the terminating resistance element R is connected to Cs3. As a result of such characteristic configurations, the isolation characteristics from the second terminal 42 to the first terminal 41 are almost flat.

Fourth Preferred Embodiment

Figure 9:
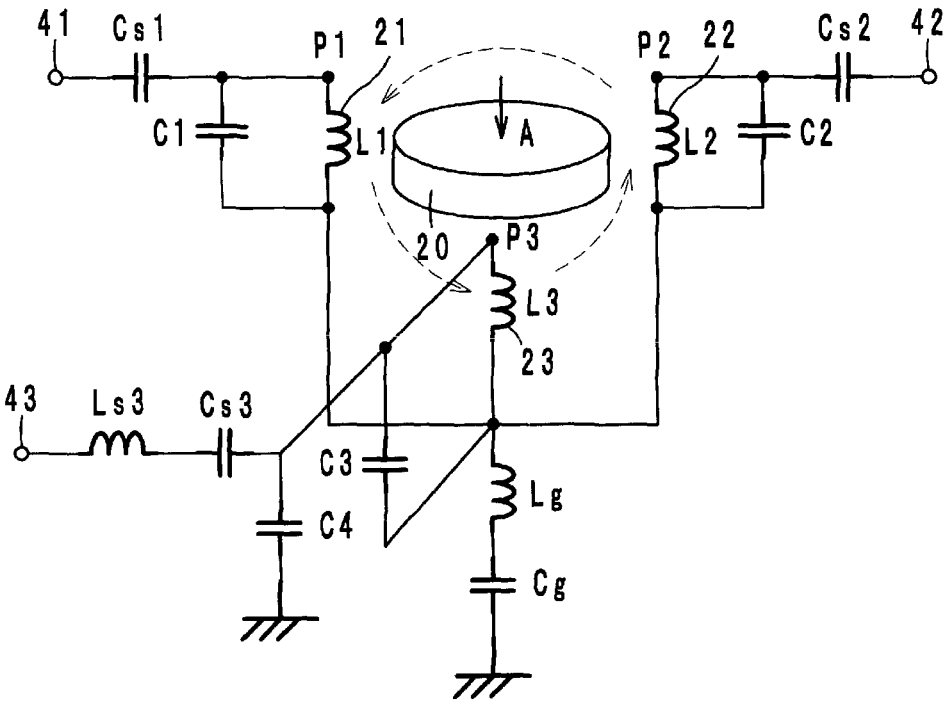
FIG. 9 is an equivalent circuit diagram illustrating a non-reciprocal circuit element (a three-port circulator) according to a fourth preferred embodiment of the present invention.

A non-reciprocal circuit element according to a fourth preferred embodiment is a concentrated-constant three-port circulator having the equivalent circuit configuration shown in FIG. 9. The same basic circuit configuration as in the second preferred embodiment preferably is used here, with differences being that a capacitance element C3 is connected instead of the inductance element LA described in the second preferred embodiment, the capacitance element Cs3 is connected in series to the connection point between one end of the third center electrode 23 and the capacitance element C3, and the inductance element Ls3 is furthermore connected in series; and that the other end of the inductance element Ls3 is connected to the third terminal 43, a capacitance element C4 is connected to the connection point between one end of the third center conductor and the capacitance element C3, and the other end of the capacitance element C4 is grounded. The specific configurations of the center conductors 21, 22, 23 are basically the same as in the perspective view shown in FIG. 2.

Figure 10:
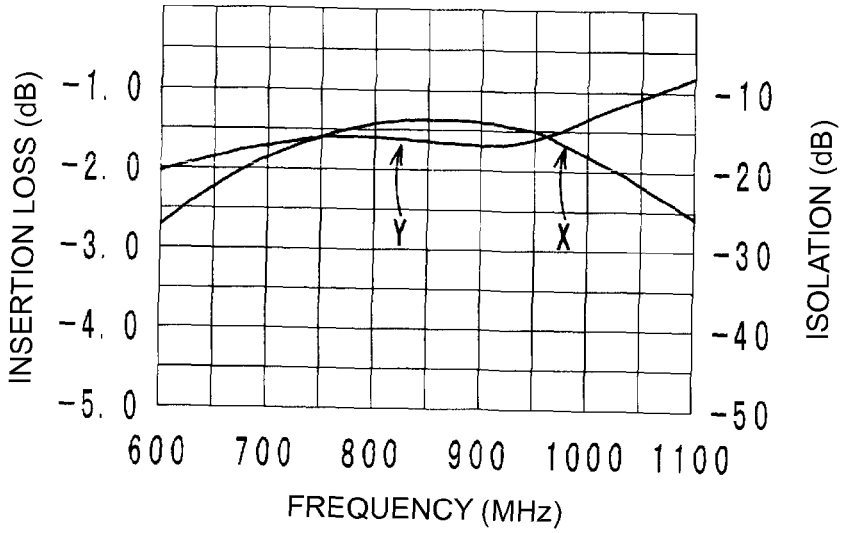
FIG. 10 is a graph illustrating insertion loss characteristics and isolation characteristics of the non-reciprocal circuit element according to the fourth preferred embodiment of the present invention.

A state of operation in the present fourth preferred embodiment is basically the same as in the first preferred embodiment, and the same actions and effects are achieved. Insertion loss characteristics from the first terminal 41 to the third terminal 43 are indicated in FIG. 10 by a curve X, whereas isolation characteristics from the first terminal 41 to the second terminal 42 are indicated in FIG. 10 by a curve Y. The isolation characteristics are almost flat in an operational bandwidth of 698-960 MHz. Furthermore, although not shown here, the isolation phase characteristic from the first terminal 41 to the second terminal 42 are almost the same as those indicated by the curve Z in FIG. 7.

Characteristic configurations of the present fourth preferred embodiment are that the other ends of respective parallel resonance circuits configured of (L1 and C1), (L2 and C2), and (L3 and C3) are all connected to a single point, and that connection point is grounded via a (Lg and Cg) serial resonance circuit; and that Cs3 is connected to the connection point between L3 and C3, Ls3 is further connected, the other end of Ls3 is connected to the third terminal 43, C4 is connected to the connection point between one end of L3 and C3, and the other end of C4 is grounded. As a result of such characteristic configurations, the isolation characteristics from the first terminal 41 to the second terminal 42 are almost flat.

Other Preferred Embodiments

Note that the non-reciprocal circuit element according to the present invention is not intended to be limited to the preferred embodiments described above, and many variations can be made thereon without departing from the essential scope of the present invention.

For example, any configuration, shape, and so on may be used for the center conductors. Furthermore, the inductance elements, capacitance elements, and so on may be configured of conductors internal to the circuit board, rather than chip-type elements mounted upon the circuit board.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A non-reciprocal circuit element comprising:

a first center conductor;

a second center conductor;

a third center conductor;

a microwave magnetic body; and a permanent magnet; wherein the first, second and third center conductors are disposed, in an insulated state and intersecting with one another, around the microwave magnetic body to which a direct current magnetic field is applied by the permanent magnet;

one end of the first center conductor defines a first port, one end of the second center conductor defines a second port, and one end of the third center conductor defines a third port;

the first port is connected to a first terminal, the second port is connected to a second terminal, and the third port is connected to a third terminal;

a first capacitance element is connected to the first center conductor in parallel, and a second capacitance element is connected to the second center conductor in parallel;

other ends of the first center conductor, the second center conductor, and the third center conductor are connected to one another, and are grounded via a first inductance element and a third capacitance element that are connected in series;

a fifth capacitance element is connected to the third center conductor in parallel;

a fourth capacitance element is connected in series to a connection point between the one end of the third center electrode and the fifth capacitance element, a third inductance element is further connected in series, and another end of the third inductance element is connected to the third terminal; and a sixth capacitance element is connected to the connection point between the one end of the third center conductor and the fifth capacitance element, and another end of the sixth capacitance element is grounded.

2. The non-reciprocal circuit element according to claim 1, wherein a seventh capacitance element is connected to the connection point between the one end of the first center conductor and the first capacitance element, and another end of the seventh capacitance element is connected to the first terminal; and an eighth capacitance element is connected to the connection point between the one end of the second center conductor and the second capacitance element, and another end of the eighth capacitance element is connected to the second terminal.

3. The non-reciprocal circuit element according to claim 1, wherein the first center conductor, the second center conductor, and the third center conductor are each disposed in line form upon the microwave magnetic body and an insulation layer.

4. The non-reciprocal circuit element according to claim 3, wherein the microwave magnetic body and the permanent magnet are disposed on the circuit board in a stacked state.

* * * * *